United States Patent [19]

Ajami

[11] Patent Number: 4,707,230

[45] Date of Patent: Nov. 17, 1987

[54] ELECTROCHEMICAL DEHALOGENATION OF ORGANIC COMPOUNDS

[75] Inventor: Alfred M. Ajami, Brookline, Mass.

[73] Assignee: Tracer Technologies, Inc., Newton, Mass.

[21] Appl. No.: 779,336

[22] Filed: Sep. 23, 1985

[51] Int. Cl.[4] ..... C25B 3/00; B01D 57/02

[52] U.S. Cl. ..... 204/131; 204/8; 204/59 R; 204/59 F; 204/72; 204/101; 260/696; 585/641

[58] Field of Search ..... 204/131, 59 R, 59 F, 204/72, 101, 8; 260/696; 585/641

[56] References Cited

U.S. PATENT DOCUMENTS

| | | | |
|---|---|---|---|
| 3,876,514 | 4/1975 | Baizer (I) | 204/59 R |
| 4,410,402 | 10/1983 | Sawyer et al. | 204/59 R |
| 4,492,617 | 1/1985 | Davies | 204/59 R |

OTHER PUBLICATIONS

Baizer (editor) Organic Electrochemistry; M. Dekker; N.Y., N.Y.; 1973, pp. 279–314.

Duty et al., Anal. Chem. 46 (1974) pp. 167–169.

Triebe et al., J.A.C.S. 101 (1979) pp. 4637–4645.

*Primary Examiner*—Arthur P. Demers

*Attorney, Agent, or Firm*—Sughrue, Mion, Zinn, Macpeak, and Seas

[57] ABSTRACT

A process for dehalogenating halogenated organic compounds comprising:

(1) combining in an electrochemical cell (a)(i) a halogenated organic compound or (ii) a solid or fluid containing a halogenated organic compound with (b) a compound capable of forming an iminium ion having the formula (I)

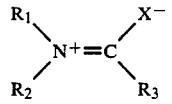

(I)

wherein

X represents an oxygen atom or a sulfur atom, $R_1$ and $R_2$, which may be the same or different, each represents an alkyl group, an aryl group or a heterocyclic group, and $R_1$ and $R_2$ may combine and form a carbocyclic ring or a heterocyclic ring, and $R_3$ represents a hydrogen atom, an alkyl group, an aryl group, a heterocyclic group or a halogen atom, and (2) applying an electrical voltage and an electrical current to an electrode of the electrochemical cell as a working electrode; which voltage is such that a reaction occurs and the halogenated organic compound is partially or completely dehalogenated.

29 Claims, No Drawings

ELECTROCHEMICAL DEHALOGENATION OF ORGANIC COMPOUNDS

FIELD OF THE INVENTION

The present invention relates to a process for removal of halogens from halogenated organic compounds. More particularly, the present invention relates to an electrochemical process for dehalogenation of halogenated organic compounds, such as polychlorinated biphenyls.

BACKGROUND OF THE INVENTION

Halogenated organic compounds are well known compounds and are used in a wide variety of applications as industrial chemical reactants, pesticides, dry cleaning solvents, electrical insulators and heat-exchange fluids. There are suspicions and a growing body of evidence that certain halogenated organic compounds may cause public health problems. As a result, federal regulations have been promulgated to control the use and level of exposure of the general public to halogenated organic compounds. Although certain halogenated organic compounds such as polychlorinated biphenyls have been widely used, they are now considered to be hazardous and their manufacture and use have been discontinued.

As indicated above, halogenated organic compounds are widely used in industry. Numerous methods exist to dispose of halogenated organic compounds and to dehalogenate the halogenated organic compounds to less toxic materials. For polychlorinated biphenyls, the only disposal procedure utilized to any degree at present is incineration at high temperature. However, extremely high temperatures must be used in this method to completely combust the higher chlorinated polychlorinated biphenyls and, unfortunately, these high temperature conditions may result in the formation of even more toxic dioxins.

Methods to dechlorinate polychlorinated biphenyls are known and they include reaction of hydroxides of alkali and alkaline earth metals with the polychlorinated biphenyls and organic solvents and the solvents are distilled off (see U.S. Pat. No. 4,477,354), reaction ofthe polychlorinated biphenyls with sodium naphthalimide generated in situ in ether-type solvents (see U.S. Pat. No. 4,326,090), reaction of the polychlorinated biphenyls with alkali metal hydroxides in polyglycol or polyglycol monoalkyl ethers (see U.S. Pat. No. 4,400,552), reaction of the polychlorinated biphenyls with nickel arylphosphine halide (see U.S. Pat. No. 4,400,566), reaction of the polychlorinated biphenyls with alkali mercaptides (see U.S. Pat. No. 4,410,422), reaction of the polychlorinated biphenyls with molten aluminum (see U.S. Pat. No. 4,469,661) and reaction of polychlorinated biphenyls with liquid sodium (see U.S. Pat. No. 4,465,590).

A review of the above methods demonstrates that the processes involved are generally useful in removing the halogens from halogenated organic compounds but that the chemical reactions require the use of hazardous materials or complicated reaction schemes.

The processes as described above are in general used to achieve dechlorination once the chlorinated organic compound has been isolated or separated from other materials. Known isolation or separation efforts to obtain the chlorinated organic materials include a solvent vapor extraction process to remove polychlorinated biphenyls from an electrical apparatus (see U.S. Pat. No. 4,483,717), use of a hot turbulent gas to remove polychlorinated biphenyls from contaminated sludges (see U.S. Pat. No. 4,402,274) and a method of solvent-extraction and degradation of polychlorinated biphenyls from contaminated oils (see U.S. Pat. No. 4,477,354). It is also known that polychlorinated biphenyls can be removed from waste oils and contaminated soils by extraction with solvents such as N,N-dimethylformamide (hereinafter dimethyl formamide or more simply "DMF") or water/kerosene mixtures as described in C. W. Haucher et al, NTIS DEA5002-619/LR (Nov. 1, 1984). It is easily recognized by those skilled in the art that these methods to isolate or separate polychlorinated biphenyls have general utility in isolating or separating halogenated organic compounds, but they are costly and their effectiveness is limited due to the large volumes of solvents required to maintain extraction efficiencies or the need for generating significant volumes of high temperature gas.

An electrochemical reaction for removal of chlorine atoms from organic compounds is disclosed in Kaabak et al, *J. Org. Chem. USSR,* 3:1 (1967). The disclosure is of a chemical reaction between a reagent and a halogenated organic compound prior to electrolysis, this initial reaction providing a charge-carrying species for the electrolysis. Halogen removal by direct electron transfer from a cathode in a halogenated organic compound reduction is described in Feoktistov, Chap. VII, *Organic Electrochemistry,* M. M. Baizer and H. Lund, Eds., Marcell Dekker, New York (1983). Radical anion catalyst-based dehalogenation is also described as a method for removing a halogen from an organic halogenated compound in T. F. Connors and J. F. Rusling, *J. Electrochem. Soc.,* 130:1120 (1983). However, even though different methods of halogen removal from halogenated organic compounds are disclosed above or extraction processes to remove such are known, the methods identified above are hazardous, complex and expensive.

SUMMARY OF THE INVENTION

Accordingly, an object of the present invention is to provide a process for dehalogenation of halogenated organic compounds which eliminates the hazards of the prior art processes noted above and which eliminates the complexity and expense of the prior art methods of removal of halogenated organic compounds or conversion of such into less toxic materials.

A further object of the present invention is to provide an improved method for dehalogenating halogenated organic compounds.

Also an object of the invention is to provide a process for removal of halogenated organic compounds from materials contaminated with halogenated organic compounds.

An even further object of this invention is to provide a unique electrochemical process for dehalogenating halogenated organic compounds.

Also, an object of this invention is to provide a process for removal of halogenated organic compounds from other organic materials wherein a single solvent extraction and dehalogenation is involved.

Accordingly, this invention provides a process for dehalogenating halogenated organic compounds comprising:

(1) combining in an electrochemical cell (a)(i) a halogenated organic compound or (ii) a solid or fluid containing a halogenated organic compound with (b) a compound capable of forming an iminium ion having the formula (I):

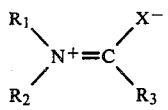

(I)

wherein

X represents an oxygen atom or a sulfur atom;

$R_1$ and $R_2$, which may the same or different, each represents an alkyl group, an aryl group or a heterocyclic group, and $R_1$ and $R_2$ may combine and form a carbocyclic ring or a heterocyclic ring;

$R_3$ represents a hydrogen atom, an alkyl group, an aryl group, a heterocyclic group or a halogen atom; in the presence of an electrically conducting medium where the compound capable of forming an iminium ion having the formula (I) does not itself provide adequate electrical conductivity for (a) and (b), and (2) applying an electrical voltage and causing an electrical current to pass to an electrode of the electrochemical cell, as a working electrode, which voltage is such that a reaction occurs and the halogenated compound is partially or completely dehalogenated.

Where necessary to achieve a homogeneous or uniform mixture of (a) and (b), for example, where a solid containing a halogenated organic compound to be dehalogenated is employed as (a), the mixture of (a) and (b) in the electrochemical cell is stirred or otherwise agitated.

In one embodiment of this invention, this invention provides the ability either to completely dehalogenate monohalogenated or polyhalogenated organic compounds or to selectively remove one or more halogen atoms from polyhalogenated organic compounds and thereby partially dehalogenate the polyhalogenated organic compound by controlling the processing conditions involved in the process of this invention.

In another embodiment of this invention, this invention provides a process for decontamination of fluids contaminated with halogenated organic compounds by selectively reacting electrochemically the halogenated organic compounds in the fluids with a compound capable of forming a iminium ion of the formula (I) and dehalogenating them.

In a further embodiment of this invention, this invention provides a process for electrochemically dehalogenating halogenated organic compounds or mixtures of halogenated organic compounds and solvents which result from the extraction of halogenated organic compounds from a solid and/or a fluid.

DETAILED DESCRIPTION OF THE INVENTION

As indicated above, the present invention provides an electrochemical process for dehalogenation of halogenated organic compounds, either alone or in admixture with other materials, for example, in admixture with organic solvents used for extraction of such as contaminants from other organic compounds or in admixture with solids such as soil, by reaction between (b) the compound forming an iminium ion having the formula (I) described above and (a) the halogenated organic compound. As a result of this electrochemically based reaction of (b) the compound forming an iminium ion having the formula (I) with (a) the halogenated organic compound, one or more up to all of the halogen atoms bonded to the organic compound are thereby removed permitting partial dehalogenation to a degree of less than complete dehalogenation to complete dehalogenation of the halogenated organic compound. Advantageously, in the process of this invention, the partial dehalogenation can be a selective dehalogenation wherein a halogen atom can be removed from a specific site of the halogenated organic compound (a) provided the potential at which this electrochemical reaction occurs is sufficiently distinct from the potential at which dehalogenation occurs at a second site.

In conducting the process of this invention, the electrochemical reaction is carried out at an electrode, hereinafter described as a "working electrode" which is maintained at a potential sufficiently cathodic with respect to a reference electrode, such as Ag/AgCl, to cause the dehalogenation reaction to occur.

In the absence of the maintenance of an appropriate voltage to this working electrode, compounds used in the present invention and capable of forming the iminium ion having the formula (I) and halogenated organic compounds do not react under normal circumstances. In order for the dehalogenation reaction to occur, sufficient voltage must be applied to the working electrode and electrical current must pass between the working electrode and another electrode, hereinafter simply designated a "counter electrode". To enable the passage of electrical current, there must be a charge-carrying material present in the electrochemical cell to act in the nature of an electrolyte. In the process of this invention, the compound capable of forming an iminium ion having the formula (I) and/or the halogenated organic compound may serve and act as the solvent for the electrolyte. In most instances in conducting the process of this invention, the compound capable of forming an iminium ion having the formula (I) will generally act as the solvent for the electrolyte because this component will generally be present in excess in the system because, in most instances, the process of this invention will be conducted to achieve complete dehalogenation of the halogenated organic compound.

The process of the present invention differs from the electrochemical reaction described by Kaabak et al, supra, in that this prior art process requires a chemical reaction between the reagent described and the halogenated organic compound prior to the electrolysis, and it is upon the product of this reaction that the electrolysis is subsequently conducted. The process of the present invention also differs from the direct electron transfer from the cathode employed in the halogenated organic compound reduction described in Feoktistov, supra, in that the compound capable of forming an iminium ion having the formula (I) which acts as the electrolyte solvent also acts as a reactant in the electrolysis and thereby accelerates the rate of halogen removal during dehalogenation. The process of the present invention further differs from the radical anion catalyst-based dehalogenation described in Connors and Rusling, supra, in that an anion-forming catalyst, such as anthracene, 9,10-diphenylanthracene or α-naphthonitrile, is not required in the process of the present invention.

The process of the present invention further differs from other electrochemical methods for dehalogenation of halogenated organic compounds in that platinum or mercury electrodes, two common and expensive or hazardous electrode materials normally used in reduction of halogenated organic compounds in electrochemical dehalogenation, as reviewed in Feoktistov, supra, are not essential and need not be used.

As indicated above, the present invention provides a process for dehalogenation of halogenated organic compounds in a simple, direct and nonhazardous way by the electrochemically based reaction of a compound capable of forming an iminium ion of the formula (I) with the halogenated organic compound.

Suitable compounds which are capable of forming an iminium ion having the formula (I) are those compounds (i) which, at a cathodic potential with respect to a standard reference electrode such as Ag/AgCl react with halogenated organic compounds, (ii) which form an iminium cation complex having the formula (Ia)

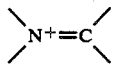

(Ia)

(iii) which are generally chemically stable at the cathodic electrical potential at which the electrochemical dehalogenation reaction occurs, (iv) which are liquid at temperatures at which electrochemical dehalogenation occurs because, in the simplest embodiment of the present invention, the compound capable of forming an iminium ion having the formula (I) is used as the electrolyte solvent and (v) which together with a solid or a fluid will dissolve sufficient charge-carrying species, to provide an electrolyte which is sufficiently electrically conductive to permit the electrical current to flow through the electrochemical cell that is necessary for the electrochemical dehalogenation reaction to proceed at a reasonable speed.

The iminium ions of the formula (I) above are formed from compounds of the formula (Ib)

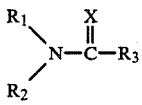

(Ib)

wherein $R_1$, $R_2$, $R_3$, and X are as described above.

Suitable examples of alkyl groups for $R_1$, $R_2$, and $R_3$ include straight chain, branched chain or cyclic alkyl groups, and the alkyl moiety can be interrupted by one or more ether or sulfide bonds or arylene groups, alkylene groups alkenylene groups or alkynylene groups or can be substituted with nitrogen-, oxygen- or sulfur-containing substituents.

Suitable specific examples of alkyl groups for $R_1$, $R_2$ and $R_3$ are alkyl groups, for example, having 1 to 8 carbon atoms, preferably 1 to 4 carbon atoms, such as a methyl group or an ethyl group.

Suitable examples of aryl groups for $R_1$, $R_2$, and $R_3$ include monocyclic, bicyclic and tricyclic aryl groups, for example, having 6 to 14 carbon atoms, more preferably 6 to 7 carbon atoms. The aryl moiety can also be substituted with one or more substituents such as nitrogen-, oxygen- or sulfur-containing substituents. Suitable examples of aryl groups for $R_1$, $R_2$ and $R_3$ include phenyl and naphthyl groups.

Suitable examples of heterocyclic groups for $R_1$, $R_2$, and $R_3$ include, for example, 3-membered to 8-membered heterocyclic rings, preferably 4-membered to 6-membered heterocyclic rings containing one or more of a nitrogen atom, an oxygen atom or a sulfur atom as heteroatoms. Suitable specific examples of heterocyclic rings for $R_1$, $R_2$, and $R_3$ are morpholine or pyridene rings.

As indicated above, $R_1$ and $R_2$ may combine to form a 4-membered to 8-membered carbocyclic ring or heterocyclic ring with one or more of a nitrogen atom, a sulfur atom or an oxygen atom as heteroatoms. Suitable examples of carbocyclic rings formed by $R_1$ and $R_2$ include a cyclohexyl ring and suitable examples of heterocyclic rings formed by $R_1$ and $R_2$ include a morpholine ring.

Suitable examples of halogen atoms for $R_3$ include a chlorine atom, a bromine atom and a fluorine atom.

Iminium ions of the formula (I) above are in general known in the art. H. Bonhme and H. G. Viehe, *Iminium Salts in Organic Chemistry,* J. Wiley & Sons, New York (1976) described a number of compounds capable of forming iminium ions of the formula (I) which can be used in the present invention.

Examples of suitable compounds which are capable of forming an iminium ion of the formula (I) include N,N-dimethyl formamide, N,N-dimethyl thioformamide, N,N-dimethyl thioacetamide, 1-methyl-2-pyrrolidinone, N,N-diethyl formamide, N,N-dimethyl acetamide, 1,1,3,3-tetramethyl urea, dimethyl tetrahydrotrimethylene-piperidone, N-formyl-piperidine, N,N-diethyl acetamide, 1,1,3,3-tetraethyl urea, N-methyl formamide, formamide and the like. Mixtures of these compounds can be used, if desired. Preferred examples of compounds capable of forming an iminium ion of the formula (I) for dechlorination of chlorinated organics include N,N-dimethyl formamide, 1-methyl-2-pyrrolidinone and N,N-dimethyl acetamide.

As indicated above, the compound capable of forming the cation or cationic complex of the formula (I) may act as an electrolyte solvent in the electrochemical system. A solute which forms electrically charged species capable of providing the electrical conductivity necessary to the electrolyte of the invention must be added to the electrochemical system. Accordingly, the term "electrolyte" as used herein is intended to cover the use of a compound capable of forming an iminium ion of the formula (I) in combination with a solute soluble in the mixture of the compound capable of forming an iminium ion of the formula (I) with the halogenated compound. The purpose of addition of such a solute is to provide charged species upon dissolution as a means of establishing the desired electrical conductivity in the electrochemical cell.

Preferred solutes are those which are economical and do not tend to react, degrade, or plate out on the electrodes at the voltage potentials necessary for the electrochemical dehalogenation of the halogenated compounds being dehalogenated. Representative examples of solutes which can be employed include tetraalkyl ammonium boron tetrafluorides, chlorides and perchlorates such as tetraethyl ammonium $BF_4$ and tetraethylammonium perchlorate.

In the process of this invention, the electrochemical dehalogenation of the halogenated organic compounds is carried out in an electrochemical cell which includes at least a working electrode at which dehalogenation occurs, and also a counter electrode to complete, with the electrolyte in the system, the electrical circuitry necessary for operation of the electrochemical cell. Also, the electrochemical cell employed in the process of this invention desirably includes a reference electrode against which specific working electrode voltage potentials can be easily selected and maintained. Control of working electrocell potential against such a reference electrode permits partial dehalogenation, and, in particular, selective dehalogenation, where less than all of the halogen atoms of the halogented organic compound or dehalogenation among a set of different halogenated organic compounds can be achieved. The reference electrode can also be employed to improve the efficiency of dehalogenation by maintaining the potential of the working electrode relative to the reference electrode employed at a fixed value, determined by routine experimentation practiceable by those skilled in the art.

A desirable potential to be maintained between the working electrode and the reference electrode can be established by standard cyclic voltammetry of the solution containing the electrolyte solution and the halogenated compound, and is the voltage observed during a voltage sweep in the cathodic direction at which the maximum flow of reaction-useful electrical current occurs. Voltage sweeps are conducted from a voltage potential at which little background current is observed to the voltage potential at which large, albeit non-useful, amounts of electrochemical degradation of electrolyte solution, viz., iminium ion forming compounds and solute, are observed. Preferably, the variation in desired working potential is held to within 0.5 volts of the observed potential at which maximum flow of reaction-useful electrical current occurs.

Suitable materials which can be employed for the working electrode in the process of the present invention most generally are those materials which will support the electrochemical dehalogenation reaction between the halogenated organic compound and the compound capable of forming an iminium ion of the formula (I). Preferably, materials for the working electrode in the process of the present invention are those materials which do not substantially degrade in or dissolve in the electrolyte before or during the electrochemical process of this invention. Particularly preferred working electrode materials include those which are effective, stable, and relatively inexpensive. Examples of preferred working electrode materials include carbon, materials rendered electrically conductive by the use of carbon therein employing various forms of carbon including graphite and acetylene black, and metals such as titanium especially when coated with other materials such as with spinels, e.g., ruthenium oxide-coated titanium electrodes. The working electrodes employed in the process of this invention may also be surface activated by operation at the desired electrical potential in a solution containing the electrolyte of choice prior to use in the electrochemical dehalogenation process of the present invention.

Suitable materials which can be employed for the counter electrode in the process of the present invention most generally are those materials which typically do not degrade during the course of the electrochemical reaction of the invention. Preferably, materials used for the counter electrode in the process of this invention will include carbon, metal, or spinel coated metals which do not substantially degrade or dissolve when operated in the electrocell of the present invention.

Suitable reference electrodes which can be used include an Ag/AgCl electrode, a Pt electrode, and other electrodes known to those skilled in the art which are stable in organic solutions containing an electrolyte.

In the process of the present invention, the halogenated organic compounds are dehalogenated by the reaction with the compound capable of forming an iminium ion having the formula (I) at a working electrode which is held at a potential suitable to permit the dehalogenation reaction to occur. The dehalogenation in the process of the present invention occurs substantially at a potential which can be approximated from the peak in reactionuseful current indicated by a determination in the presence of the halogenated organic compound and the compound capable of forming an iminium ion having the formula (I). The desired voltage potential is established through conventional cyclic voltammetry, e.g., at a glassy carbon electrode or other similar electrode used in cyclic voltammetry as described in E. Gileadi et al, *Interfacial Electrochemistry*, Addison-Wesley (1975).

As will be recognized by those skilled in the art, the level of current at the above-defined desired potential can be used to determine the relative effectiveness of compounds capable of reacting in the electrochemical system described by the present invention. More specifically, the peak current observed in carrying out cyclic voltammetry with a particular system for a constant voltage sweep rate is related to the rate of the electrochemical irreversible reaction as described in R. S. Nicholson and I. Shain, *Anal. Chem.* 36:7066 (1964).

Compounds capable of forming iminium ions of the formula (I) preferred in the present invention are those compounds which produce a maximum reaction-useful current in the electrochemical reaction with the halogenated organic compound of interest. This maximum reaction-useful current is the current above the background electrolysis current of the compound alone in the electrolyte solution at the potential observed to correspond to halogen removal from the halogenated organic compound in cyclic voltammetry of the electrolyte solution containing the compound capable of forming the iminium ion having the formula (I) and the halogenated organic compound.

The desired potential between the working electrode and the reference electrode will vary with the specific electrochemical processing involved, i.e., the particular combination of compound capable of forming an iminium ion of the formula (I) and the halogenated organic compound. This potential can be easily determined by routine experimentation. In general the potential employed will most broadly range from 0 to −5 volts, more particularly from −1 to −3 volts, with respect to a Ag/AgCl reference electrode. The current at the working electrode can vary widely depending upon the electrolyte employed and the concentration used. In general, currents will range from 0.1 to 100 amperes per square foot and, more particularly, from 1 to 20 amperes per square foot.

Appropriate concentrations and amounts of the compound forming an iminium ion of the formula (I), the halogenated organic compound, and any solute necessary for electroconductivity purposes can be determined on a case-by-case basis using routine skill in the art following the principles set forth above. However, in general, a suitable concentration of the halogenated organic compound dehalogenated by the process of the present invention can range from measurement detection limits, typically about 1 ppm to 100,000's of ppm, preferably from detection limits to about 500,000 ppm in the electrochemical cell. The amount of the compound capable of forming an iminium ion having the formula (I) can range from detection limits to nearly 100% of the fluid contents of the electrochemical cell depending upon the objective of the cell operation. If complete dehalogenation is desired, at a minimum, sufficient compound forming an iminium ion having the formula (I) must be added to satisfy the dehalogenation reaction requirements. Typically, the compound forming an iminium ion having the formula (I) is added in substantial excess of the minimum required for reaction because it is used as the solvent for the charge-carrying solute required so that an electrochemical reaction can proceed. The amount of solute such as alkyl ammonium $BF_4$, alkyl ammonium chloride or alkyl ammonium perchlorate salts employed to improve the electrical conductivity in the electrolyte solution in the electrolytic cell can range from about 0.001M to about 5M, preferably 0.01M to 0.5M.

It should be emphasized that the amounts of these materials set forth should not be interpreted as being limiting but rather the amounts are merely exemplary. Using ordinary skill in the art and routine experimentation, one can appropriately select concentrations and amounts to maximize and achieve the advantages set forth above for the process of this invention.

The process of the present invention also can be carried out over a wide range of temperatures and pressures. While the temperature range employed in conducting the dehalogenating process of the present invention is not critical, basically a temperature up to the boiling point of the compound capable upon of forming an iminium ion having the formula (I) or the halogenated organic compound, whichever is lower, to a temperature as low as the temperature at which the electrolyte solution becomes effectively nonelectrically conducting, and thus the rate of electrochemical reaction is limited, or at which the compound capable of forming an iminium ion having the formula (I) or the halogenated compound is no longer soluble in the electrolyte solution, whichever is higher, can be used. A preferred temperature range is ambient temperature up to a temperature at which the rate of electrochemical reaction is increased yet the energy to achieve and maintain this temperature is sufficiently low that the expense of conducting the process of this invention is minimized. A suitable range thus will be about −40° C. to about 125° C. and more specifically 10°l C. to 90° C.

As one skilled in the art will recognize, the process of this invention can be conducted as a batch process, as a semicontinuous process, or as a continuous process, as desired.

Suitable examples of halogenated organic compounds which can be dehalogenated in accordance with the process of the present invention include halogenated materials such as polychlorinated biphenyls, polybrominated biphenyls, hexachlorobenzene iodobenzene, 1,4-diiodobenzene, 1,5-diiodopentane, 1-iodopentane, bromobenzene, 1-bromopentane, 1,4-dibromobenzene, 2-bromobiphenyl, fluorobenzene, 2-fluorobiphenyl, 1,4-difluorobenzene, pentachlorophenyl, tetrachloroethane, trichloroethylene, etc. and mixtures thereof, e.g., Aroclor 1242, which is a mixture of trichlorobiphenyls. The process of the present invention is particularly useful with respect to dehalogenation of halogenated organic compounds such as those polychlorinated biphenyls and chlorinated solvent mixtures used in electrical equipment, heat exchange equipment and the like.

The process of the present invention can also be conducted to dehalogenate halogenated organic compounds dissolved in a fluid or mixed with a solid, e.g., by conducting the process of the present invention directly on the fluid or solid containing the halogenated organic compound or by first pretreating the fluid or solid with an extracting solvent capable of selectively extracting out the halogenated organic compound and then conducting the dehalogenation process of the present invention on the halogenated organic compound in admixture with the extracting solvent.

Suitable selective extracting solvents which can be used include those selective for the halogenated organic compound of interest. With knowledge of the halogenated organic compound of interest, suitable extracting solvents can be easily selected using ordinary skill in the art. Suitable examples of extracting solvents which can be used in this embodiment of the process of the present invention include perchloroethylene, methylene chloride, butyrolactone, propylene carbonate, dimethyl formamide, an the like. These extracting solvents, such as dimethyl formamide can also be a compound capable of forming an iminium ion having the formula (I) used in the electrochemical process of this invention and use of these types of solvents is preferred. Thus, the process of the present invention can be conducted on transformer fluids such as mineral oils, silicone oils, perchloroethylene, etc., contaminated with halogenated organic compounds and on the full range of solvents which might be used for cleaning equipment contaminated with halogenated organic compounds.

The process of the present invention is further illustrated by reference to the following examples which are given for the purposes of exemplification and are not to be construed as limiting. Unless otherwise indicated herein, all parts, percents, ratios, and the like, are by weight.

EXAMPLE 1

Cyclic voltammetry was carried out at approximately 20° C. (room temperature) using an electrochemical cell containing a freshly cleaned glassy carbon electrode (0.07 $cm^2$ surface area ("SA")) as a working electrode for dehalogenation with a platinum flag counter electrode (1 $cm^2$ SA) and a standard Ag/AgCl reference electrode. A mixture of a compound capable of forming an iminium ion of the formula (I) as shown in Table 1 below with 0.1M tetraethyl ammonium perchlorate ("TEAP") as the electrolyte was placed in the electrochemical cell. The electrical current as a function of voltage with respect to the Ag/AgCl reference electrode was determined in the presence and in the absence of 715 ppm of Askarel, a transformer oil containing approximately 50% by weight of a mixture of hexachlorobiphenyls with the remainder being tri- and tetrachlorobenzene as a halogenated organic compound. Cyclic voltammetric (CV) sweeps were carried out at a rate of 200mV/sec over the range of +1.5 to −3.5 V versus the Ag/AgCl electrode starting at 0 V and proceeding cathodically. A peak in the reaction-useful current was observed at approximately −2.5 V versus Ag/AgCl with N,N-dimethylformamide (DMF) as the compound capable of forming the iminium ion of the formula (I) and Askarel as the mixture of halogenated organic compounds. A peak at a similar voltage was observed with other compounds capable of forming iminium ions of the formula (I) as approximately shown in Table 1 below.

Table 1 below shows the results obtained in terms of the magnitude of the background current at −2.5 V versus Ag/AgCl in the absence of the halogenated organic compound, of the current magnitude that occurred at the peak at −2.5 V versus Ag/AgCl in the presence of the halogenated organic compound and of the difference between the background current and the peak current. This difference is related to the rate of dechlorination of the halogenated organic compound present and demonstrates one criterion for the preference ordering among compounds capable of forming an iminium ion of the formula (I) for the practice of the present invention for the dehalogenation of the polychlorinated biphenyls present in Askarel-type transformer oils. Data of the type as shown in Table 1 below can also be used to identify suitable compounds capable of forming iminium ions of the formula (I) which are suitable for use but which are less preferred due to their increased rate of electrochemical degradation at −2.5 V versus Ag/AgCl. Examples of these compounds with respect to the Askarel as the halogenated organic compound include N,N-diethyl formamide, N-N-diethyl acetamide, N-methyl formamide and formamide. With its low background current, high effective dehalogenation current, and low cost, and within the limits of the data in Table 1, N,N-dimethyl formamide is preferred. However, it will be clear to one skilled in the art that the choice of preferred compound forming an iminium ion having the formula (I) will vary with the specific circumstances of the application and that the procedures for establishing that preferred compound are herein described and are easily applied by one skilled in the art.

TABLE 1

Halogenated Organic Compound Reaction Activity as a Function of Iminium Ion Forming Compound*

| Complex Forming Compound | Background Current** (μA) | Dehalogenation Peak Current*** (μA) | Difference (μA) |
|---|---|---|---|
| N,N—Dimethyl formamide | 65 | 290 | 225 |
| 1-Methyl-2-pyrrolidinone | 85 | 275 | 190 |
| N,N—Diethyl formamide | 250 | 412 | 160 |
| N,N—Dimethyl acetamide | 65 | 230 | 155 |
| 1,1,3,3-Tetramethyl urea | 75 | 165 | 90 |
| Dimethyl tetrahydro-trimethylene-piperidone | 50 | 120 | 70 |
| N—Formyl-piperidine | 40 | 80 | 40 |
| N,N—Diethyl acetamide | 175 | 212 | 37 |
| 1,1,3,3-Tetraethyl urea | 13 | 13 | 0 |
| N—Methyl formamide | 300 | — | — |
| Formamide | 275 | — | — |

*Electrochemical cell conditions employed were those defined in Example 1.
**In the absence of 715 ppm of Askarel as the mixture of halogenated organic compounds.
***In the presence of 715 ppm of Askarel as the mixture of halogenated organic compounds.

EXAMPLE 2

Cyclic voltammetry was carried out at room temperature at a fleshly cleaned glassy electrode (0.07 $cm^2$ SA) with a platinum flag counter electrode (1 $cm^2$ SA) and with Ag/AgCl as a reference electrode. A mixture of 0.1M TEAP and DMF as the compound capable of forming an iminium ion having the formula (I) was used as the electrolyte solution in the electrochemical cell. The voltage and the current at the peak reaction-useful current was determined for each of the halogenated organic compounds as shown in Table 2 below (wherein the amount of the halogenated organic compound was 2 mM for the bromo- and iodo compounds shown in Table 2 below and 500 ppm in the chloro compounds shown in Table 2 below except for Aroclor 1242 which is at 1 mM) for the cyclic voltammetric sweep which was carried out at a rate of 200 mV/sec over the range of 0 to −4 V versus Ag/AgCl, starting at 0 V and proceeding cathodically.

Table 2 shows the halogenated organic compounds employed, the approximate voltage versus Ag/AgCl of the current peak of the dehalogenation, and the approximate magnitude of this current. The results in Table 2 identify the approximate potential which can be used for the electrochemical dehalogenation which occurs in the process of the present invention. Potentials more or less cathodic than listed also can be employed for dehalogenation. However, more cathodic potentials may be less electrochemically efficient and thus more costly due to increased levels of electrolyte degradation. Potentials more anodic than the peak can also be used for dehalogenation but the rate of dehalogenation may be decreased due to a reduced rate of reaction.

The data provided in Table 2 show six peaks observed in voltage, and the corresponding current levels arising, for dehalogenation of the six chlorine atoms of hexachlorobenzene. Thus, a direct correspondence is shown between the number of halogens and the number of dehalogenation peaks for hexachlorobenzene. Other more cathodic peaks were also observed for other polyhalogenated organic compounds shown in Table 2, but only the first cathodic peak is shown in Table 2 for each halogenated organic compound listed.

TABLE 2

Potentials for and Currents of Dehalogenation Using N,N—Dimethyl Formamide

| Halogenated Organic Compound | Peak Voltage (V vs Ag/AgCl) | Peak Current (μA) |
|---|---|---|
| Aroclor 1242* | −2.3 | 150 |
| Hexachlorobenzene | −1.4 | 65 |
| | −1.6 | 100 |
| | −1.9 | 130 |
| | −2.2 | 155 |
| | −2.5 | 200 |
| | −2.8 | 260 |
| Iodobenzene | −2.4 | 175 |
| 1,4-Diiodobenzene | −2.4 | 190 |
| 1,5-Diiodopentane | −2.3 | 155 |
| 1-Iodopentane | −2.3 | 135 |
| Bromobenzene | −3.2 | 175 |
| 1-Bromopentane | −3.0 | 175 |
| 1,4-Dibromobenzene | −3.4 | 315 |
| 2-Bromobiphenyl | −2.8 | 150 |
| Fluorobenzene | −2.9 | 115 |
| 2-Fluorobiphenyl | −3.4 | 450 |
| 1,4-Difluorobenzene | −3.1 | 130 |
| Pentachlorophenol | −2.5 | 135 |
| Tetrachloroethane | −2.4 | 140 |
| Trichloroethylene | −2.3 | 210 |

*A mixture of trichlorobiphenyls.

EXAMPLE 3

The electrochemical cell used comprised a synthetic resin conductive working electrode (7.5 $cm^2$ SA; an electrode comprising a polypropylene based-carbon composite film produced by Polymer Concentrates, Inc.), an inert counter electrode comprising a platinum flag and a Ag/AgCl electrode as a reference electrode. The working electrode was prepared by warming the polypropylene-based carbon composite film (8 mil thick) from Polymer Concentrates, Inc. until the surface just melted, dusting such with a conductive carbon black from Cabot Corp. (trademark Vulcan X-C) and pressing the combination to 4,000 psi.

The electrochemical cell was filled with a mixture of 70 ml of 715 ppm of Askarel (a mixture of polychlorinated biphenyls and chlorinated benzenes (as described in Example 1)) with dimethyl formamide as the compound capable of forming an iminium ion having the formula (I) as a liquid. 0.05M tetraethyl ammonium $BF_4$ (TEAB) was employed in the mixture as the electrolyte. The cell was operated with stirring with the working electrode being held at −2.5 V versus Ag/AgCl using a potentiostat (Amel Model 551). The cell current was allowed to float. The cell current was observed to decrease to approximately 15 mA during the course of the electrochemical reaction. The number of coulombs passed was measured using a current integrator (Amel Model 721). The cell load voltage was approximately 5 V. The electrochemical dehalogenation of the polychlorinated biphenyl was carried out in this electrochemical cell.

Samples of the liquid mixture were withdrawn and analyzed for polychlorinated biphenyl using gas chromatography and for the presence of chloride ion therein by titration of a 50 v/o aqueous solution with 0.02N silver nitrate aqueous solution to a silver chromate end-point.

Table 3 shows the results obtained and these results demonstrate polychlorinated biphenyl dehalogenation to be complete to less than 5 ppm in less than 16 hours. The results in Table 3 show that chloride ions are a product of the dehalogenation. Table 3 also shows the number of electrons required per chloride ion released. An increase in electron consumption per chloride removed as the concentration of PCB fell was observed as was expected. Excess electrons were consumed in the degradation of iminium-forming compound (as shown by the background current listed in Table 1 of Example 1), the amount being a function of the voltage applied to the cell and the concentrations of chlorinated hydrocarbons in the system.

TABLE 3

Halogenated Organic Compound (PCB) Dechlorination

| Reaction Time (hrs) | PCB Conc. (mg/l) | $Cl^-$ Conc. (mM*) | PCB Balance (%) | Electrons Consumed Per $Cl^-$ |
|---|---|---|---|---|
| 0 | 500 | 0.00 | 0 | — |
| 0.083 | 431 | 0.43 | 14 | 2.0 |
| 0.5 | 373 | 1.53 | 25 | 1.7 |
| 1.0 | 359 | 2.35 | 28 | 2.9 |
| 2.0 | 158 | 5.00 | 68 | 4.0 |
| 15.5 | <0.5 | 7.00 | 100 | 15.8** |

*At complete conversion, and assuming Askarel contains approximately 50 w/o hexachlorobiphenyl (a PCB), complete dechlorination of the PCB in the sample should result in an approximately 7 mM solution of $Cl^-$.

**In the absence of chlorinated organic compound, the compound capable of forming an iminium ion of the formula (I) will draw a current and degrade at a limited rate.

EXAMPLE 4

The electrochemical cell described in Example 3 was used with a Ag/AgCl reference electrode, and with treated titanium working and counter electrodes of a titanium foil (7.5 $cm^2$ SA), which had been treated at 450° C. three times with a coating of a solution of butyltitanate (30 v/o), $RuCl_3.H_2O$ (10 w/o), HCl (4 v/o), and butanol (62 v/o). By this treatment of the titanium foil, a protective conductive metal oxide spinel was formed on the titanium foil. The liquid present in the electrochemical cell contained 70 ml of 2 mM 1,4-dibromobenzene with dimethyl formamide as the compound capable of forming an iminiun ion having the formula (I) along with 0.05M TEAB as the electrolyte. The electrochemical cell was operated at −3.4 V versus Ag/AgCl using a potentiostat (Amel Model 551). The cell current was allowed to float. The cell current was observed to hold at approximately 150 mA throughout the dehalogenation. The cell voltage was approximately 13 V.

Table 4 shows the bromide concentration present in the electrolyte liquid over a period of time when the bromide concentration was determined by titration of a 50 v/o aqueous solution with 0.01N silver nitrate solution to a silver chromate end-point. The results show that dehalogenation was complete in less than 15 hours based on the concentration of bromide formed as the reaction product in the liquid used as the electrolyte.

TABLE 4

Dehalogenation of 1,4-Dibromobenzene

| Time hrs | $Br^-$ Concentration* (mM) | Extent of Reaction Based on $Br^-$ Concentration (%) |
|---|---|---|
| 0 | 0.0 | — |
| 0.2 | 0.7 | 18 |
| 4 | 2.9 | 73 |
| 16 | 4.0 | 100 |

*At 100% debromination and assuming a single reaction product of inorganic bromide, the electrochemical cell bromide concentration should be approximately 4 mM solution of $Br^-$.

Reference Example 1

An electrochemical cell, with the electrodes and electrolyte as described in Example 4, was employed but without the 1,4-dibromobenzene present. This cell was run for approximately 1 hour (486 coloumbs) at a floating current of approximately 120 mA at a fixed potential of −3.4 V versus Ag/AgCl between the working and the reference electrode. A sample of the liquid used as the electrolyte solution was withdrawn and analyzed for the presence of halogen ion by titration of a 50 v/o aqueous solution with 0.01N silver nitrate aqueous solution to a silver chromate end-point. The presence of halogen ion was not detected. These results demonstrate that the source of halogen ion detected in the liquid containing the electrolyte during the dehalogenation and after the dehalogenation as set forth in Examples 3 and 4 above was the halogenated organic compound.

EXAMPLE 5

An electrochemical cell, with electrodes as described in Example 3, was employed. The 70 ml of liquid used as the cell consisted of 65 v/o of 0.05M TEAB in dimethyl formamide as the compound capable of forming an iminium ion of the formula (I) and 35 v/o of a mineral oil (Univolt N-61, produced by Exxon) of the type generally used as a dielectric fluid in transformers. The mineral oil contained 714 mg of Askarel, a mixture of chlorinated hydrocarbons as described in Example 1, per 1000 g of mineral oil. The liquid in the electrochemical cell was stirred throughout the dehalogenation to maintain a physically uniform liquid system. The potential of the working electrode was held at −2.5 V versus Ag/AgCl. The current was allowed to float and the current was observed to decrease over time to approximately 15 mA. A cell voltage of approximately 5 V was observed. After the electrochemical reaction had been allowed to proceed for specific time intervals, the stirring of the electrolyte was stopped. An almost immediate separation of the oil and the dimethyl formamide phases occurred. A sample of the dimethyl formamide phase was recovered from the electrochemical cell and was analyzed for chloride ion by titration of a 50 v/o aqueous solution with a 0.02N silver nitrate aqueous solution to a silver chromate end-point.

Table 5 shows the results obtained.

TABLE 5

| Dehalogenation of PCB in Mineral Oil | |
|---|---|
| Time (hrs) | $Cl^-$ Concentration (mM) |
| 0 | 0.0 |
| 1 | 0.7 |
| 2 | 1.0 |
| 24 | 2.6 |

These results demonstrate the electrochemical dehalogenation of substantial amounts of halogenated organic compounds which contaiminate other organic materials can be accomplished in situ when compounds capable of forming an iminium ion having the formula (I) are used to continuously react with the halogenated organic compound obtained from fluid contaminated with the halogenated organic compound in an electrochemical dehalogenation. One skilled in the art will appreciate that similar results would occur in the case of a mixture of halogenated organic compound and solids, e.g., a soil contaminated with a halogenated organic compound.

While the invention has been described in detail and with reference to specific embodiments thereof, it will be apparent to one skilled in the art that various changes and modifications can be made therein without departing from the spirit and scope thereof.

What is claimed is:

1. A process for dehalogenating a halogenated organic compound comprising:

(1) combining in an electrochemical cell (a)(1) a halogenated organic compound or (ii) a solid or liquid containing a halogenated organic compound, with (b) a compound capable of forming an iminium ion having the formula (I)

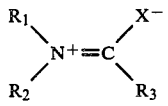

(I)

where

X represents an oxygen atom or a sulfur atom, $R_1$ and $R_2$, which may be the same or different, each represents an alkyl group, an aryl group or a heterocyclic group wherein when X is an oxygen atom, $R_1$ and $R_2$ are not simultaneously a methyl group, and $R_1$ and $R_2$ may combine and form a carbocyclic ring or a heterocyclic ring, and $R_3$ represents a hydrogen atom, an alkyl group, an aryl group, a heterocyclic group or a halogen atom, and (2) applying an electrical voltage and an electrical current to an electrode of said electrochemical cell as a working electrode; which voltage is such that a reaction occurs and the halogenated organic compound is partially or completely dehalogenated due to said reaction and the interaction of said iminium ion forming compound with said halogenated compound.

2. The process of claim 1, wherein said process comprises completely dehalogenating said halogenated organic compound.

3. The process of claim 1, wherein said process comprises selectively dehalogenting said halogenated organic compound.

4. The process of claim 1, wherein said process comprises less than completely dehalogenating said halogenated organic compound.

5. The process of claim 1, wherein said compound capable of forming said iminium ion having the formula (I) is, 1-methyl-2-pyrrolidinone, N,N-diethyl formamide, N,N-dimethyl acetamide, 1,1,3,3-tetramethyl urea, dimethyl tetrahydrotrimethylene-piperidone, N-formyl-piperidine, N,N-diethyl acetamide, 1,1,3,3-tetraethyl urea, N-methyl formamide, formamide or mixtures thereof.

6. The process of claim 5, wherein said compound capable of forming said iminium ion having the formula (I) is, N,N-dimethyl acetamide, 1-methyl-2-pyrrolidinone or mixtures thereof.

7. The process of claim 1, wherein said halogenated organic compound comprises mixtures of halogenated organic compounds.

8. The process of claim 1, wherein said halogenated compound is polyhalogenated organic compound.

9. The process of claim 8, wherein said polyhalogenated organic compound is a polychlorinated organic compound or a polybrominated organic compound.

10. The process of claim 9, wherein said polychlorinated organic compound is a polychlorinated biphenyl and said polybrominated compound is a polybrominated biphenyl.

11. The process of claim 1, wherein said halogenated compound is hexachlorobenzene, iodobenzene, 1,4-diiodobenzene, 1,5-diiodopentane, 1-iodopentane, bromobenzene, 1-bromopentane, 1,4-dibromobenzene, 2-bromobiphenyl, fluorobenzene, 2-fluorobiphenyl, 1,4-difluorobenzene, pentachlorophenyl, tetrachloroethane, trichloroethylene or mixtures thereof.

12. The process of claim 8, wherein said polyhalogenated compound is polychlorinated biphenyl.

13. The process of claim 1, wherein said halogenated compound is hexachlorobenzene, trichloroethylene, tetrachloroethane or mixtures thereof.

14. The process of claim 1, wherein said process includes passing an electric current between a working electrode and a counter electrode and through an electrolyte solution comprising (a) said halogenated organic compound and (b) said compound capable of forming an iminium ion having the formula (I) or (a) said halogenated organic compound, (b) said compound capable of forming an iminium ion having the formula (I) and additionally (c) an electroconductivity increasing solute.

15. The process of claim 14, wherein said electrolyte solution comprises (a) said halogenated organic compound, (b) said compound capable of forming an iminium ion having the formula (I) and (c) said electroconductivity increasing solute.

16. The process of claim 15, wherein said electroconductivity increasing solute is a tetraalkyl ammonium $BF_4$ salt, a tetraalkyl ammonium chloride salt or a tetraalkyl ammonium perchlorate salt.

17. The process of claim 15, wherein said process for dehalogenating said halogenated organic compound is conducted at an electrical potential between said working electrode and an Ag/AgCl electrode as a reference electrode of about 0.5 volts less than to about 0.5 volts more than the voltage at which maximum current flows as determined using cyclic voltammetry.

18. A process for decontaminating a solid or liquid containing a halogenated organic compound as a contaminant comprising:

(1) contacting said solid or liquid contaminated with said halogenated organic compound with an extracting solvent capable of selectively extracting out said halogenated organic compound to provide a mixture of said solvent and said halogenated organic compound, (2) combining in an electrochemical cell (a) said mixture of said solvent and said halogenated organic compound, with (b) a compound capable of forming an iminium ion having the formula (I)

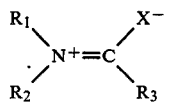

(I)

wherein

X represents an oxygen atom or a sulfur atom, $R_1$ and $R_2$, which may be the same or different, each represents an alkyl group, an aryl group or a heterocyclic group, wherein when X is an oxygen atom, $R_1$ and $R_2$ are not simultaneously a methyl group, and $R_1$ and $R_2$ may combine and form a carbocyclic ring or a heterocyclic ring, and $R_3$ represents a hydrogen atom, an alkyl group, an aryl group, a heterocyclic group or a halogen atom, and (3) applying an electric voltage and an electrical current to an electrode of said electrochemical cell as a working electrode; which voltage is such that a reaction occurs and the halogenated organic compound is partially or completely dehalogenated due to said reaction and the interaction of said iminium ion forming compound with said halogenated compound.

19. The process of claim 18, wherein said process comprises completely dehalogenating said halogenated organic compound.

20. The process of claim 18, wherein said compound capable of forming said iminium ion having the formula (I) is 1-methyl-2-pyrrolidinone, N,N-diethyl formamide, N,N-dimethyl acetamide, 1,1,3,3-tetramethyl urea, dimethyl tetrahydrotrimethylene-piperidone, N-formyl-piperidine, N,N-diethyl acetamide, 1,1,3,3-tetraethyl urea, N-methyl formamide, formamide or mixtures thereof.

21. The process of claim 20, wherein said compound capable of forming said iminium ion having the formula (I) is N,N-dimethyl acetamide, 1-methyl-2-pyrrolidinone or mixtures thereof.

22. The process of claim 18, wherein said halogenated organic compound comprises mixtures of halogenated organic compounds.

23. The process of claim 18, wherein said halogenated compound is polyhalogenated organic compound.

24. The process of claim 23, wherein said polyhalogenated organic compound is a polychlorinated organic compound or a polybrominated organic compound.

25. The process of claim 24, wherein said polychlorinated organic compound is a polychlorinated biphenyl and said polybrominated compound is a polybrominated biphenyl.

26. The process of claim 18, wherein said halogenated compound is a polychlorinated biphenyl.

27. The process of claim 18, wherein said process includes passing an electric current between a working electrode and a counter electrode and through an electrolyte solution comprising said extracting solvent, (a) said halogenated organic compound and (b) said compound capable of forming an iminium ion having the formula (I) or said extracting solvent, (a) said halogenated organic compound, (b) said compound capable of forming an iminium ion having the formula (I) and additionally (c) an electroconductivity increasing solute.

28. The process of claim 27, wherein said electrolyte solution comprises said extracting solvent, (a) said halogenated compound, (b) said compound capable of forming an iminium ion having the formula (I) and (c) said electroconductivity increasing solute.

29. The process of claim 28, wherein said electroconductivity increasing solute is a tetraalkyl ammonium $BF_4$ salt, a tetraalkyl ammonium chloride salt or a tetraalkyl ammonium perchlorate salt.

* * * * *